United States Patent [19]

Landon et al.

[11] Patent Number: 4,462,889

[45] Date of Patent: Jul. 31, 1984

[54] NON-CONSUMABLE ELECTRODE FOR MOLTEN SALT ELECTROLYSIS

[75] Inventors: Thomas E. Landon, Johnson City; Duane R. Secrist, Elizabethton; James M. Clark, Johnson City, all of Tenn.

[73] Assignee: Great Lakes Carbon Corporation, New York, N.Y.

[21] Appl. No.: 540,885

[22] Filed: Oct. 11, 1983

[51] Int. Cl.[3] ..... C25C 7/00; C25C 3/00

[52] U.S. Cl. ..... 204/292; 204/67; 75/234

[58] Field of Search ..... 204/292, 67; 75/230, 75/232, 234, 246

[56] References Cited

U.S. PATENT DOCUMENTS

| | | | |
|---|---|---|---|
| 4,155,758 | 5/1979 | Evans | 75/232 |
| 4,357,226 | 11/1982 | Alder | 204/286 |
| 4,374,050 | 2/1983 | Ray | 204/67 |
| 4,379,033 | 4/1983 | Clark | 204/67 |
| 4,399,008 | 8/1983 | Ray | 204/67 |

*Primary Examiner*—John F. Niebling

*Attorney, Agent, or Firm*—R. Laddie Taylor

[57] ABSTRACT

A non-consumable cermet electrode for electrolytic proceses comprises at least about 75 vol. % of a hexagonal ferrite component ceramic composition and no more than about 25 vol. % of a metal component.

4 Claims, 2 Drawing Figures

NON-CONSUMABLE ELECTRODE FOR MOLTEN SALT ELECTROLYSIS

DESCRIPTION

BACKGROUND OF THE INVENTION

1. Field of the Invention

Aluminum is produced in Hall-Heroult cells by the electrolysis of alumina in molten cryolite using conductive carbon electrodes. During the reaction the carbon anode is consumed at the rate of approximately 450 kg/mT of aluminum produced under the overall reaction $$2Al_2O_3 + 3C \xrightarrow[Na_3AlF_6]{940°-1000° C.} 4Al + 3CO_2.$$

The problems caused by the consumption of the anode carbon are related to the cost of the anode consumed in the reaction above and to the impurities introduced to the melt from the carbon source. The petroleum cokes used in the anodes generally have significant quantities of impurities, principally sulfur, silicon, vanadium, titanium, iron and nickel. Sulfur is oxidized to its oxides causing particularly troublesome workplace and environmental pollution. The metals, particularly vanadium, are undesirable as contaminants in the aluminum metal produced. Removal of excess quantities of the impurities requires extra and costly steps when high purity aluminum is to be produced.

If no carbon is consumed in the reduction the overall reaction would be $2Al_2O_3 \rightarrow 4Al + 3O_2$ and the oxygen produced could theoretically be recovered. More importantly, when no carbon is consumed, there is no contamination of the atmosphere or the aluminum product from the impurities present in the coke.

Attempts have been made in the past to use non-consumable electrodes with little apparent success. Metals either melt at the temperature of operation, or are attacked by oxygen or by the cryolite bath. Ceramic compounds such as oxides with perovskite and spinel crystal structures usually have too high electrical resistance or are attacked by the cryolite bath. Electrodes consisting of metals coated with ceramics using conventional methods have also shown poor performance, in that almost inevitably, even the smallest crack leads to attack on the metal substrate by the molten salt bath.

2. Description of the Prior Art

Recently, efforts have been made to fabricate non-consumable electrodes from special compositions known as cermets. A cermet composition is defined as one consisting of both metallic and ceramic phases. The conventional method of preparing cermet compositions is to mix metal and ceramic powders, cold press a preform, and sinter the preform at an elevated temperature in a controlled atmosphere. Alternatively, the cermet may be prepared by hot pressing or hot isostatic pressing wherein the pressing and sintering operations are performed concomitantly. Cermets have high electrical conductivity in comparison to ceramic compositions and good corrosion resistance when compared to metals.

U.S. Pat. No. 4,374,050 to Ray provides a non-consumable electrode for molten salt electrolysis fabricated from at least two metals or metal compounds combined to provide a combination metal compound containing at least one of the group consisting of oxide, fluoride, nitride, sulfide, carbide or boride, the combination metal compound defined by the formula:

$$\left(\sum_{i=1}^{m} (M_i)F_{Mi}\right)\left(\sum_{j=1}^{p} (M_j)F'_{mj} \sum_{i=1}^{m} (M_i)F'_{Mi}\right)_Z\left(\sum_{r=1}^{n} X_rF_{xr}\right)_K$$

where $\sum_{i=1}^{m} F_{Mi} = 1$; $\sum_{j=1}^{p} F'_{Mj} + \sum_{i=1}^{m} F'_{Mi} = 1$ and $$\sum_{r=1}^{n} X_rF_{xr} = 1;$$

where Z is a number in the range of 1.0 to 2.2; K is a number in the range of 2.0 to 4.4; $M_i$ is at least one metal having a valence of 1, 2, 3, 4 or 5 and is the same metal or metals wherever $M_i$ is used in the composition; $M_j$ is a metal having a valence of 2, 3 or 4; $X_r$ is at least one of the elements from the group consisting of O, F, N, S, C and B; m, p and n are the number components which comprise $M_i$, $M_j$ and $X_r$; $F_{Mi}$, $F'_{Mj}$, $F'_{Mi}$ or $F_{xr}$ are the mole fractions of $M_i$, $M_j$ and $X_r$ and $0<\Sigma F'_{Mi}<1$.

U.S. Pat. No. 4,374,761—Ray relates to non-consumable electrodes for molten salt electrolysis comprised of a ceramic oxide composition and at least one metal powder dispersed through the ceramic oxide composition for purposes of increasing its conductivity, the metal powder selected from the group consisting of Ni, Cu, Co, Pt, Rh, In and Ir.

U.S. Pat. No. 4,397,729 to Duruz et al. discloses a non-consumable anode for molten salt electrolysis consisting of a cermet material formed from a ceramic oxide of, e.g., a ferrite or chromite, and a metal, e.g., a noble metal or alloy thereof.

European patent application No. 30,834 to Wheeler et al. discloses a non-consumable anode used in the production of aluminium from a cryolite-based fused bath containing alumina consisting of a sintered self-sustaining ceramic oxide body of spinel structure which is made conductive by selective partial substitution, the introduction of non-stoichiometry, or by doping so as to maintain the impurities in the produced aluminium at low levels. Preferred materials are partially-substituted nickel ferrite spinels.

U.K. patent application No. 2,069,529A to Duruz et al. provides a non-consumable anode for molten salt electrolysis consisting of a cermet material comprising at least one ceramic oxide such as chromite or ferrite of iron or nickel or ferric or chromic oxide and at least one metal such as nickel or chromium or a noble metal, e.g., palladium, or an alloy of such metals.

SUMMARY OF THE INVENTION

Our invention is a cermet non-consumable electrode useful for molten salt electrolysis and is particularly suitable as an anode for the electrolysis of alumina in a Hall-Heroult cell. The electrode functions as the active electrolytic element and is well adapted to carry current from the electrode current source to the electrolyte. The electrode is corrosion-resistant in a Hall-Heroult cell melt and has the advantage of being less contaminating to the product aluminum than the electrodes described in the prior art.

DETAILED DESCRIPTION OF THE INVENTION

The major component of our electrode is a hexagonal ferrite. The composition range for hexagonal ferrites is shown with the aid of the composition diagram of FIG. 1 (adapted from J. Smit and H. P. J. Wijn, *Ferrites,* John Wiley (1959), p. 177.). $A_i$ represents a divalent ion from the first transition series, or an ion not of the first transition series but known to be accommodated in spinel ferrite structures, specifically, Sn, Zr, Nb, Ta, Hf, Mg, Li, or an ion pair with one of the pair having a valence of 1+ and the other member of the pair having a valence of 3+, such as ($Li^{1+}$, $Fe^{3+}$), or any combination of these. The oxide of $A_i$ is shown in the diagram as $A_iO$. $A_j$ is a metallic ion of a sesquioxide or combination of sesquioxides of the form $(A_j)_2O_3$. In this invention, $A_j$ is principally Fe but a significant portion of the iron may be replaced by one or more of Al, Co, Cr, Y, or Mn. $A_k$ represents a divalent ion selected from a member of the Lanthanide series, La, Pb, the alkaline earth group excluding Mg, and combinations thereof.

Figure 1:
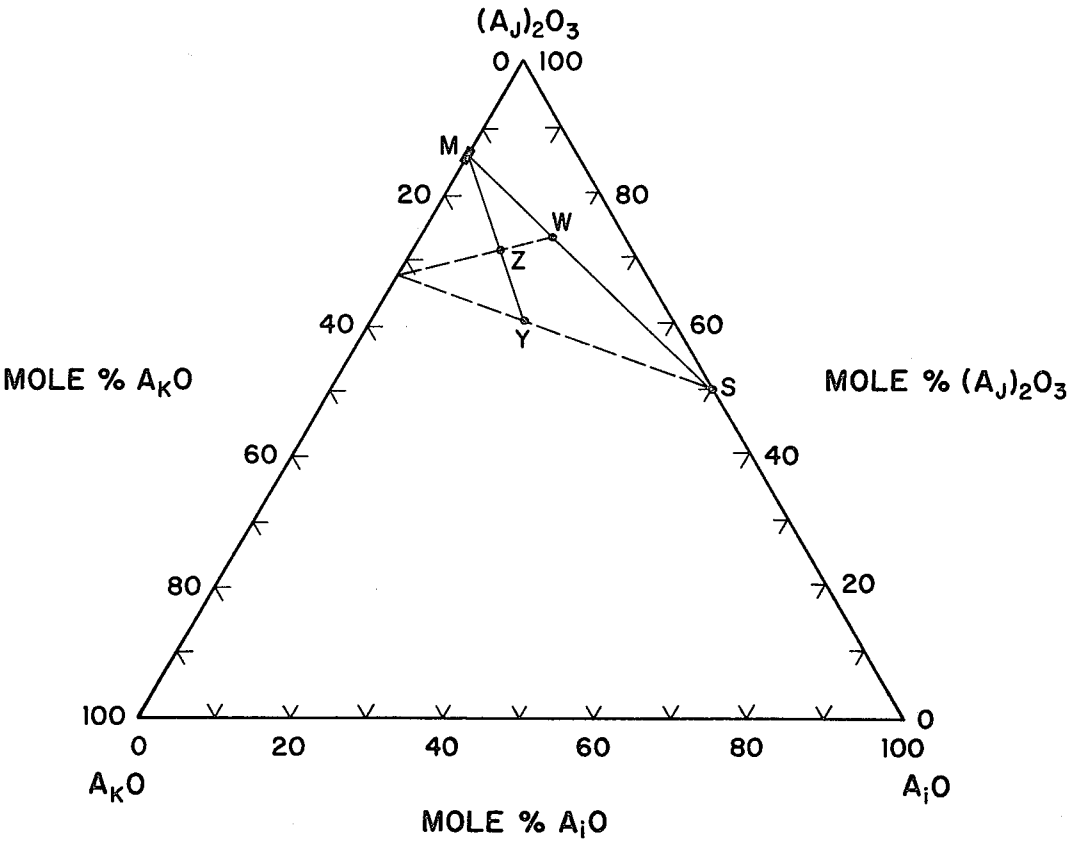
FIG. 1 is a composition diagram which illustrates compositions based on spinel hexagonal crystal structures.

Referring again to the composition diagram of FIG. 1, it is seen that the composition S is located at the midpoint of the line connecting $A_iO$ and $(A_j)_2O_3$, representing 50 mole % $A_iO$ and 50 mole % $(A_j)_2O_3$. This composition corresponds to stoichiometric spinel, designated by the chemical formula $A_i(A_j)_2O_4$. Spinel crystallizes in the cubic system, that is, the oxygen ions are arranged in a cubic array, and the $A_i$ and $A_j$ ions are arranged in four-coordinated and six-coordinated interstices. Movement along the line connecting $A_iO$ and $(A_j)_2O_3$ represents compositions deviating from the stoichiometric spinel; the cubic spinel structure persists as a single phase, however, provided the limit of solid solubility for these constituents is not exceeded. The spinel structure can also accommodate 2–3 atomic % of $A_kO$. In excess of the solid solubility limits, either $A_iO$, $A_kO$, or $(A_j)_2O_3$ will precipitate as a second phase depending on which is in excess. The ceramic phases of the compositions described in U.S. Pat. Nos. 4,374,050, 4,374,761, and 4,397,729 are all located along the $A_iO$–$(A_j)_2O_3$ line. The present invention makes no claim to compositions along this line.

The composition M, corresponding to 14.3 mole % $A_kO$ and 85.7 mole % $(A_j)_2O_3$, lies along the $A_kO$–$(A_j)_2O_3$ line. M has the formula $A_k(A_j)_{12}O_{19}$ and is a hexagonal ferrite with the so-called magnetoplumbite structure. As is characteristic of the hexagonal ferrites, the oxygen ions are arranged in a hexagonal array, and the $A_k$ ions are located on oxygen sites at regular intervals. The ionic radius of $A_k$ is comparable to that of O. $A_j$ ions are distributed interstitially in 4, 5 and 6-coordinated sites. There is no corresponding composition with this structure on the $A_iO$–$(A_j)_2O_3$ line because the $A_i$ ions are too small to occupy a stable position in the O lattice. The range of solid solubility of $A_kO$–$(A_j)_2O_3$ is shown in the composition diagram as a heavy line bounded by $A_k(A_j)_{11}O_{16.5}$ and $A_k(A_j)_{13}O_{19.5}$.

Other compounds crystallizing in the hexagonal structure in the $A_iO$–$(A_j)_2O_3$–$A_kO$ system are found at points W, Y, and Z. Compound W is represented by the formula $A_k(A_i)_2(A_j)_{16}O_{27}$, Y by the formula $(A_k)_2(A_i)_2(A_j)_{12}O_{22}$, and Z by the formula $(A_k)_3(A_i)_2(A_j)_{24}O_{41}$. As in compound M, the $A_k$ ions are located on the hexagonal O sites, and $A_j$ and $A_i$ ions are distributed interstitially in 4, 5, and 6-coordinated sites.

Figure 2:
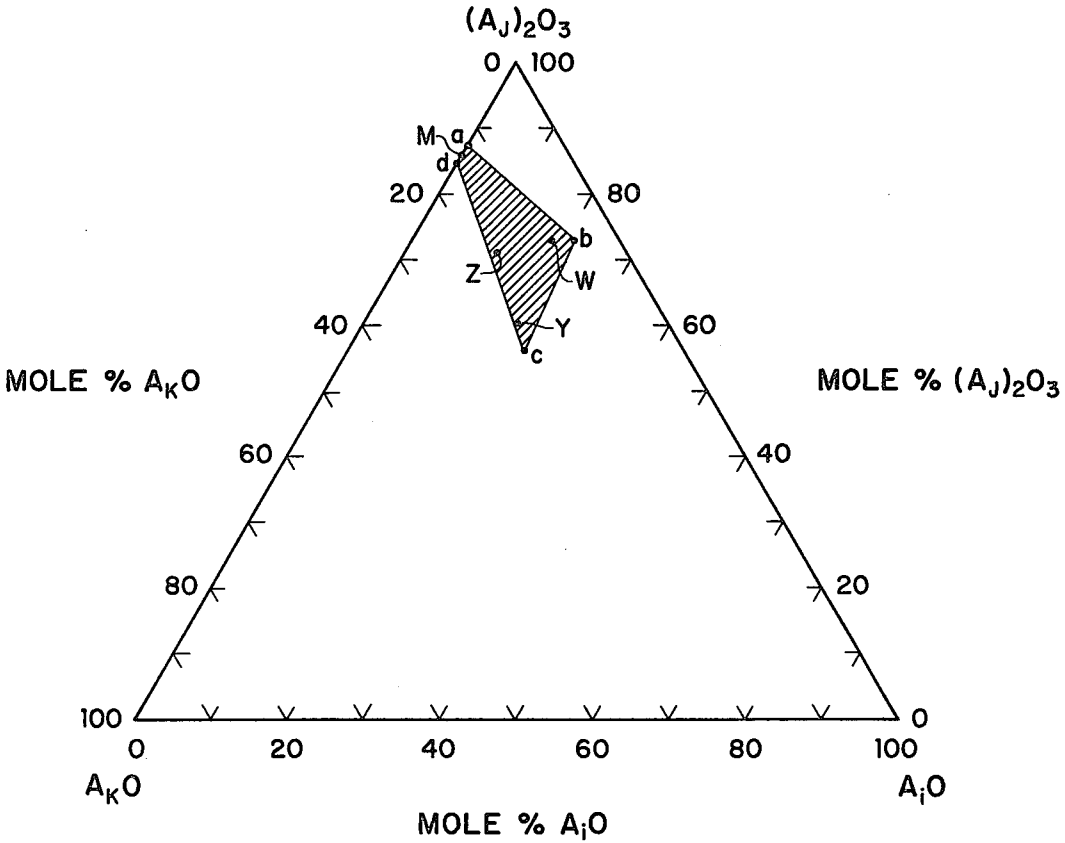
FIG. 2 is a composition diagram, the shaded area which defines the hexagonal ferrites of the invention.

The shaded area of the composition diagram of FIG. 2 shows the range of existence of the hexagonal ferrites. The area is bounded by the points a, b, c, and d, inclusive, and the compositions representing each of these points are shown below. The compounds located within the shaded area are solid solutions of M, W, Y, and Z.

TABLE I

| Hexagonal Ferrite Composition Range* | | | |
|---|---|---|---|
| Points | $A_iO$ | $(A_j)_2O_3$ | $A_kO$ |
| a | 0 | 87 | 13 |
| b | 21 | 73 | 6 |
| c | 23 | 56 | 21 |
| d | 0 | 85 | 15 |

*Components expressed as mole %

Ionic substitutions, both cationic and anionic, may be made in the hexagonal ferrites to alter the chemical or electrical properties of the compounds. For example, typical substitutions in the M compound $BaFe_{12}O_{19}$ are as follows:

1. Replacement of $Ba^{2+}$ with another ion of 2+ valence.

$$M^{2+}Fe_{12}^{3+}O_{19}$$

where $M^{2+}$ is Sr or Pb.

2. Partial substitution of $Ba^{2+}$ with another ion of 2+ valence.

$$(Ba_{1-x}^{2+}M_x^{2+})Fe_{12}O_{19}$$

where $M^{2+}$ is Sr, Pb (x=0.0–1.0) or Ca (x=0.0–0.7)

3. Simultaneous substitution of $Ba^{2+}$ with an ion of 3+ valence and of $Fe^{3+}$ with an ion of 2+ valence.

$$(Ba_{1-x}^{2+}M_x^{3+})(M_x^{2+}Fe_{12-x}^{3+})O_{19}$$

where $M^{3+}$ is Y, La, Pr, Nd, Sm, Eu and where $M^{2+}$ is Co, Ni, Fe

4. Partial substitution of $Fe^{3+}$ with another ion of 3+ valence.

$$Ba^{2+}(M_x^{3+}Fe_{12-x}^{3+})O_{19}$$

where $M^{3+}$ is Al, Cr, In, Ru

5. Partial substitution of $Fe^{3+}$ with a 2+/4+ ion pair.

$$Ba^{2+}(M_x^{2+}M_x^{4+}Fe_{12-2x}^{3+})O_{19}$$

where $M^{2+}$ is Zn, Ni, Co, Fe and where $M^{4+}$ is Ti

6. Partial substitution of $Fe^{3+}$ with a 2+/5+ ion pair.

$$Ba^{2+}(M_{2x}^{2+}M_x^{5+}Fe_{12-3x}^{3+})O_{19}$$

where $M^{2+}$ is Zn, Fe and where $M^{5+}$ is V, Nb, Ta, Sb

7. Simultaneous substitution of $F^-$ for $O^{2-}$ and an ion of 2+ valence for $Fe^{3+}$.

$$Ba^{2+}(M_x^{2+}Fe_{12-x}^{3+})O_{19-x}F_x^-$$

where $M^{2+}$ is Co, Ni, Fe and x=0.0–2.0

Analogous substitutions may be made in the W, Y, and Z ferrite compounds. Examples of other hexagonal ferrites suitable as the major component in the cermet electrode of our invention are as follows:

| | |
|---|---|
| $Ba_{0.5}Ca_{0.5}Fe_{10}Al_2O_{19}$ | $Sr_{0.9}Ba_{0.1}Fe_{11.5}Sb_{0.5}O_{19}$ |
| $Sr_{0.5}La_{0.5}Fe_{12}O_{17.5}F_{1.5}$ | $BaFe_{11.5}Ti_{0.5}O_{19}$ |
| $BaNi_2Fe_{16}O_{27}$ | $Ba_{0.8}Ca_{0.2}Ni_{1.5}Fe_{16.5}O_{27}$ |
| $BaMnZnFe_{16}O_{27}$ | $Ba_2NiZnNbFe_{11}O_{22}$ |
| $BaLaLiFe_{13}O_{22}$ | $Ba_3Ni_2TaFe_{23}O_{41}$ |

These substitutions are made with the object of improving the electrical conductivity of the ceramic, increasing the resistance of the electrode to attack by molten cryolite, and/or introducing elements into the ceramic that are non-contaminating to the electrolyte and the product aluminum.

For example, stoichiometric $BaFe_{12}O_{19}$ is electrically insulating. In this material, all of the iron ions are in their 3+ valence state. Substitution for $Fe^{3+}$ with ions of a higher valence will convert a number of the iron ions to the 2+ valence in order to maintain charge neutrality. For instance, for every $Fe^{3+}$ ion replaced by a 5+ ion, two $Fe^{2+}$ ions are produced. The presence of $Fe^{2+}$ and $Fe^{3+}$ on equivalent crystallographic sites renders the material electrically conductive.

Accordingly, a series of $BaFe_{12}O_{19}$ specimens was prepared with varying levels of antimony (5+) substituted for iron. Appropriate quantities of $BaCO_3$, $Fe_2O_3$, and $Sb_2O_5$ were ball milled together in water; the mixture was dried, granulated, compacted into pellets, and sintered for 6 hours at 1420° C. in flowing oxygen. The effect of the antimony content on the conductivity of the ceramic is shown in Table II below.

TABLE II

Effect of Antimony Substitution on Electrical Conductivity

| Composition | Electrical Conductivity @ 950° C. ($\Omega^{-1}$ – $cm^{-1}$) |
|---|---|
| $BaFe^{2+}_{0.32}Fe^{3+}_{11.52}Sb^{5+}_{0.16}O_{19}$ | 5.0 |
| $BaFe^{2+}_{0.66}Fe^{3+}_{11.01}Sb^{5+}_{0.33}O_{19}$ | 7.7 |
| $BaFe^{2+}_{1.0}Fe^{3+}_{10.5}Sb^{5+}_{0.50}O_{19}$ | 14.3 |

Additions of $Ta^{5+}$, $Nb^{5+}$, and $Ti^{4+}$ were found to have the same effect on electrical conductivity as $Sb^{5+}$ so long as the ratio of $Fe^{2+}$ and $Fe^{2+}$ is held constant. The corrosion resistance of these materials under electrolysis conditions, however, was found to be unacceptable.

In another experiment, fluorine was substituted for oxygen in an attempt to increase the corrosion resistance of the hexagonal ferrite ceramic. The composition $BaFe_{12}O_{17}F_2$ was prepared by blending appropriate quantities of $BaF_2$ and $Fe_2O_3$, pressing to form a pellet and sintering. If great care is not taken during sintering to insure the absence of water, the $BaF_2$ will react with the water by the reaction $$BaF_2 + H_2O \rightarrow BaO + 2HF$$

and all fluorine will be lost from the sample. Therefore, the fluorine-substituted pellet was vacuum dried at 300° C. before introducing the dry 98% $N_2$/2% $O_2$ atmosphere used for sintering. When this pellet was tested as an anode in a Hall-Heroult electrolyte, the corrosion was reduced approximately 50% over the antimony-substituted hexagonal ferrite. However, the corrosion rate was still short of that required for commercial application.

The addition of an appropriate metal to the hexagonal ferrite constituent to form a cermet material was found to substantially improve corrosion resistance as well as electrical conductivity. The reaction bonding which takes place between the metal and oxide constituents during heat treatment alters the properties of these materials in a synergistic fashion such that the desired improvement is realized. Metals found to be particularly beneficial are Ni, Fe, Cu, Co, or Cr or mixtures thereof. The metal content of the cermet electrode material should not exceed 25% by volume and preferably should be 10–20% by volume.

The cermet electrode composition described herein comprising a hexagonal ferrite component ceramic composition lying within the area defined as a-b-c-d of the composition diagram of FIG. 2 and a metal component selected from Ni, Fe, Cu, Co, or Cr or mixtures thereof constitutes our invention. Such a material can be prepared by blending the desired metal and hexagonal ferrite constituents in powder form to effect thorough mixing, molding the mixed powders into a green electrode, and sintering the electrode under controlled atmosphere conditions to stabilize the hexagonal ferrite primary phase. Other processing techniques known in the art may be employed to fabricate the electrode.

PREFERRED EMBODIMENTS

The preferred embodiments of the invention will now be described in the following non-limiting examples.

EXAMPLE 1

A cermet anode of composition 16 vol. % Ni/84 vol. % $BaNi_2Fe_{15.84}Sb_{0.16}O_{27}$ was prepared and tested as follows: a mixture of 682 gm $Fe_2O_3$, 42 gm $Fe_3O_4$, 112 gm $BaCO_3$, 135 gm $NiCO_3$, and 29 gm $Sb_2O_5$ was wet milled for 6 hours. After drying, the material was granulated and calcined at 1250° C. for 6 hours in static air to pre-react the powders. The milling and drying steps were repeated a second time. To 262.5 gm of this powder, 87.5 gm of 1μ average diameter nickel metal powder was added and the mixture dry blended for one hour. A cylindrically shaped pellet, 2.5 cm in diameter by 7.6 cm in length, was formed from the powder by isostatic molding at 20,000 psi (138 MPa). The cylinder was sintered in vacuum for 6 hours at 1225° C. to produce a test anode with an Archimedes density of 5.37 gm/cm$^3$.

The anode was electrolyzed for 24 hours with a current density of 1.0 amp/cm$^2$ impressed on the anode tip in a Hall-Heroult melt at 970° C. The melt contained $Na_3AlF_6$ and $AlF_3$ in a $NaF/AlF_3$ weight ratio of 1.2, 7 wt. % $CaF_2$, and $Al_2O_3$ in excess of 8 wt. %. Anode corrosion was determined by measuring the changes in the axial and radial dimensions of the test sample. Only a slight reduction in the radial dimension was noted, whereas a slight increase was observed for the axial dimension.

EXAMPLE 2

A sample of composition 16 vol. % (70 mole % Ni, 30 mole % Cu)/84 vol. % $BaNi_2Fe_{15.84}Sb_{0.16}O_{27}$ was prepared by dry blending for one hour a mixture of 51 grams of 1 micron particle size Ni powder, 22 grams of −325 mesh size Cu powder, and 227 grams of $BaNi_2Fe_{15.84}Sb_{0.16}O_{27}$ powder processed as described in Example 1. A cylindrical pellet, 2.5 cm in diameter by 7.6 cm in length, was formed from the cermet powder by isostatic molding at 20,000 psi (138 MPa), and the pellet was sintered in vacuum for 24 hours at 1175° C. The Archimedes density of the pellet was 5.92 g/cm$^3$. The sample was tested as an anode in a Hall-Heroult melt in the same manner as the anode of the first example. After 24 hours of electrolysis, the anode showed evidence of a very slight reduction in the radial dimension and a slight increase in the axial dimension.

While the invention has been described in detail and with reference to the drawings and specific embodiments thereof, it will be apparent to one skilled in the art that various changes and modifications can be made therein without departing from the scope and spirit thereof, and, therefore, the invention is not intended to be limited except as indicated in the appended claims.

We claim:

1. A cermet electrode composition comprising:

(a) at least about 75 vol. % of a hexagonal ferrite component ceramic composition wherein the mole % proportion of components $A_iO$, $(A_j)_2O_3$ and $A_kO$ of said ceramic composition lie within the area defined as a-b-c-d of the composition diagram of FIG. 2 of the drawings, where:

$A_i$ is selected from the group consisting of a divalent ion from the first transition series, Sn, Zr, Nb, Ta, Hf, Mg, Li, an ion pair with one of the pair having a valence of 1+ and the other member of the pair having a valence of 3+, and combinations thereof;

$A_j$ is selected from the group consisting of an Fe ion or a mixture of said Fe ion and one or more ions of Al, Co, Y or Mn;

$A_k$ is a divalent ion selected from the group consisting of a member of the Lanthanide series, La, Pb, the alkaline earth group excluding Mg, and combinations thereof; and O is oxygen; and (b) no more than about 25 vol. % of a metal component selected from the group consisting of Ni, Fe, Cu, Co, Cr and mixtures thereof.

2. The cermet electrode composition of claim 1 wherein the ceramic composition is BaNi hexagonal ferrite and the metal component is selected from the group consisting of Ni, Cu and mixtures thereof.

3. A cermet electrode consisting of 84 vol. % $BaNi_2Fe_{15.84}Sb_{0.16}O_2$ and 16 vol. % Ni.

4. A cermet electrode consisting of 84 vol. % $BaNi_2Fe_{15.84}Sb_{0.16}O_{27}$ and 16 vol. % (70 mole % Ni, 30 mole % Cu).

* * * * *